US010594105B2

(12) United States Patent
Kerner et al.

(10) Patent No.: US 10,594,105 B2
(45) Date of Patent: Mar. 17, 2020

(54) RADIAL JACK

(71) Applicants: Amphenol-Tuchel Electronics GmbH, Heilbronn (DE); Fritz Stepper GmbH & Co. KG, Pforzheim (DE)

(72) Inventors: Wolfgang Kerner, Erlenbach (DE); Joachim Stolz, Besigheim (DE); Christian Ungerer, Untergruppenbach-Unterheinriet (DE); Alexander Schreck, Heilbronn (DE); Wolfgang Katz, Leingarten (DE); Martin Wacker, Ohringen (DE); Raimund Ochs, Pforzheim (DE)

(73) Assignees: Amphenol-Tuchel Electronics GmbH, Heilbronn (DE); Fritz Stepper GmbH & Co. KG, Pforzheim (DE)

( * ) Notice: Subject to any disclaimer, the term of this patent is extended or adjusted under 35 U.S.C. 154(b) by 0 days.

(21) Appl. No.: 16/098,788

(22) PCT Filed: Apr. 28, 2017

(86) PCT No.: PCT/EP2017/060274
§ 371 (c)(1),
(2) Date: Nov. 2, 2018

(87) PCT Pub. No.: WO2017/191064
PCT Pub. Date: Nov. 9, 2017

(65) Prior Publication Data

US 2019/0131755 A1 May 2, 2019

(30) Foreign Application Priority Data

May 3, 2016 (DE) ..... 10 2016 108 254

(51) Int. Cl.
*H01R 43/16* (2006.01)
*H01R 13/11* (2006.01)
*H01R 13/187* (2006.01)

(52) U.S. Cl.
CPC ..... *H01R 43/16* (2013.01); *H01R 13/111* (2013.01); *H01R 13/187* (2013.01)

(58) Field of Classification Search
CPC ..... H01R 43/16; H01R 13/111; H01R 13/187
USPC ..... 439/884, 842, 843, 847, 851, 852, 854, 439/345, 350
See application file for complete search history.

(56) References Cited

U.S. PATENT DOCUMENTS 2,711,524 A * 6/1955 Beaver ..... H01R 13/111 439/851
4,657,335 A * 4/1987 Koch ..... H01R 13/187 439/851
5,151,560 A * 9/1992 Kreinberg ..... H01R 4/26 174/78

(Continued)

FOREIGN PATENT DOCUMENTS

CN 100550539 C 10/2009
DE 8902356 U1 8/1990

(Continued)

*Primary Examiner* — Travis S Chambers
(74) *Attorney, Agent, or Firm* — Blank Rome LLP

(57) ABSTRACT

The invention relates to a method for manufacturing an electric connector jack comprising a cylindrical jack sleeve which includes a receiving space into which a cylindrical contact lamination grating is inserted that has a plurality of parallel contact laminations.

12 Claims, 2 Drawing Sheets

(56) References Cited

U.S. PATENT DOCUMENTS

| | | | | |
|---|---|---|---|---|
| 5,449,304 | A * | 9/1995 | Huss, Jr. | H01R 13/18 439/825 |
| 5,879,205 | A * | 3/1999 | Egenolf | H01R 13/11 29/882 |
| 8,366,473 | B2 * | 2/2013 | Kataoka | H01R 13/506 439/350 |
| 8,858,274 | B2 * | 10/2014 | Jakoplic | H01R 13/11 439/843 |
| 2002/0187686 | A1 | 12/2002 | Zhao et al. | |
| 2003/0068931 | A1 * | 4/2003 | Swearingen | H01R 4/4881 439/843 |
| 2010/0173539 | A1 * | 7/2010 | Furutani | H01R 4/185 439/852 |
| 2013/0171892 | A1 * | 7/2013 | Hachadorian | H01R 13/052 439/884 |

FOREIGN PATENT DOCUMENTS

| | | | |
|---|---|---|---|
| DE | 10005297 | A1 | 8/2001 |
| DE | 102004002921 | A1 | 10/2001 |
| DE | 10 2004 002 921 | A1 | 10/2004 |
| DE | 102011105821 | A1 | 11/2011 |
| DE | 102015213674 | A1 | 1/2016 |
| DE | 20 2016 100 095 | U1 | 3/2016 |
| GB | 2398680 | A | 8/2004 |
| WO | 2008042080 | A1 | 4/2008 |
| WO | 2011077190 | A2 | 6/2011 |

* cited by examiner

RADIAL JACK

RELATED APPLICATIONS

This application is a national stage application of International Application No. PCT/EP2017/060274, filed Apr. 28, 2017, which claims priority to German Patent Application No. 10 2016 108 254.6, filed May 3, 2016, the entire disclosures of which are hereby incorporated by reference.

The invention relates to an electrical plug-in connector jack which is designed as a radial contact jack and has a plurality of longitudinal contact elements for contacting a corresponding plug-in pin and a sleeve surrounding the longitudinal contact elements.

The present invention moreover relates to a method for producing an electrical plug-in connector jack formed by a plurality of longitudinal contact elements for contacting a corresponding plug and with a jack sleeve surrounding the longitudinal contact elements.

US 2002/0187686 A1 discloses a jack with a T-shaped connection, and the manufacture of a laminated contact consisting of a laminated cage and a rolled contact holder which are twisted in a complex fashion and with the aid of various tools into the shape of a sandglass.

A jack which is formed into a sleeve by a relative rotational movement of the ends of a laminated cage is likewise described in U.S. Pat. No. 4,657,335. Rings are superposed on the respective ends of the sleeve in order to fix the laminated cage in the sleeve.

US 2003/0068931 A1 discloses an electrical plug-in connector jack comprising an essentially cylindrical jack sleeve which is provided at its front ends with recesses in order to fasten a hyperbolically rotated laminated cage with its connection tongues on or in these recesses.

DE 10 2011 105 821 B4 moreover discloses an electrical plug-in connector jack with a cylindrical jack sleeve, wherein the jack sleeve with a receiving space in which a hyperbolically rotated laminated cage is attached, and the jack sleeve has a first and second front face, and the laminated cage is connected to connection tongues on the first and second front face of the jack sleeve, positively to the latter, and that perforations are made in the transition area between the jack sleeve and the connection tongues, and that at least one of the connection tongues of the laminated cage projects through one of the perforations.

The solutions known from the prior art all have the disadvantage that the contact elements are very complex to produce, and in particular the geometrical dimensions of the sleeves, end sleeves, and a laminated cage also need to be coordinated. Because of the manufacturing process, there is an undesirable tolerance range, which entails considerable practical problems. High-precision tubes routinely need to be used for the sleeves because the inner tube of the laminated cage must in each case fit into the tubular shape of the surrounding sleeve and the surrounding sleeve may in turn also need to be inserted into a further sleeve holder and fastened there. Because precision tubes can typically be processed by turning so that the desired tolerances can be achieved, the complexity of producing a contact system with such sleeves is not economically possible.

The sleeves are alternatively produced in a roller bending process. The "dovetail connections" known from the prior art which serve as connecting elements and are formed on opposite side edges of a piece of sheet metal make the production process complex.

When a sleeve is formed from a piece of sheet metal with such dovetail connections, a special joining movement of the tool is thus required. On the one hand, the piece of sheet metal needs to be rolled so that it assumes the shape of a sleeve and, on the other hand, the dovetail connections need to be joined together in different planes.

Such a dovetail connection is known, for example, from US 2002/0187686 A1. The production of a high-voltage contact element according to the method disclosed therein is consequently complex, complicated, and uneconomical for producing high volumes of plug-in connectors.

A common problem is also that the laminated cage is twisted inside the sleeve such that retaining devices need to be provided between the sleeve and the laminated cage in order, on the one hand, to fix the cage rotationally effectively in the sleeve and, on the other hand, to engage inside the cage with a tool in order to twist the cage about its center axis such that the contact laminations are constricted inside.

A further very significant problem is represented by such contact systems in which a cylindrical contact lattice, in particular one rolled into a cylinder, is fastened at both end margins in the sleeve surrounding the contact lattice and is hence clamped at both sides.

Generic plug-in connector jacks therefore generally comprise an inserted contact lattice which is connected to the sleeve by means of complex bonded joining methods (such as, for example, welding).

Moreover, the sleeve itself often also needs to be bulged because the dovetail connections do not provide sufficient grip.

In the case of a conventional fixed contact lattice, during use multiple other problems occur because the contact system is overstressed by the presence of an excessive number of retaining points. As a result, during the plugging process and later operation, increased loads occur at both clamping points owing to vibrations, forces that are exerted, and thermomechanical effects because, after a corresponding pin is inserted, the contact is clamped such that it is not able, as it were, to avoid any of the abovementioned forces.

The object of the present invention is therefore to overcome the abovementioned disadvantages and to manufacture a plug-in connector jack in a significantly simpler and more economical fashion, wherein at the same time it is intended to reduce the number of components and in particular the production rate can be significantly increased.

The invention is achieved by a plug-in connector jack having the features of claim 1, and a method according to the features of claim 9.

The basic concept of the present invention is thus to produce the cylindrical sleeve not in the manner known from the prior art, by means of a dovetail connection in an overlapping fit, but to provide a joining contour consisting of multiple specifically shaped joining elements at both abutting edges of a piece of sheet metal such that no use is made of an overlapping fit (like a jigsaw puzzle) but instead a joining fit formed by moving the front side edges of the piece of sheet metal to be shaped toward each other with a deforming movement.

According to the invention, a method for producing an electrical plug-in connector jack is therefore proposed, comprising a cylindrical jack sleeve, wherein the jack sleeve is designed with a receiving space in which a cylindrical contact lamination lattice with a plurality of contact laminations extending parallel to one another is inserted, having the following method steps:

a. Producing an essentially flat sheet-metal part consisting of two end sections and a central (integral) portion situated between them, wherein the sheet-metal part has two longitudinal side edges which extend in each case from one end section to the opposite end section, and in each case a transverse side edge on one of the two end sections, said transverse side edge delimiting the end sections, wherein, in each case in an extension of the longitudinal side edges, two retaining arms project at the end from one transverse side edge of the sheet-metal part, to be precise from one end section, wherein the retaining arms have, at their respective free retaining arm end, a latching lug for engagement in an undercut which in each case takes the form of a corresponding recess in the opposite end section of the piece of sheet metal;

b. Introducing an intended bending point for each of the retaining arms in the respective longitudinal side edge in the region of the respective retaining arm;

c. Rolling the sheet-metal part to form a cylindrical jack sleeve, wherein, when they strike or meet the corresponding front side of the opposite end section of this sheet-metal part, as intended the retaining arms attached to the end section of the sheet-metal part are first sprung and/or bent outward about the previously introduced intended bending point until the latching lugs of the retaining arms spring some way further into the corresponding recess at the corresponding end section.

In other words, this means that when the sheet-metal part is rolled up to form the jack sleeve, there is a forced bending movement of the retaining arms during which the latter run on corresponding control curves on the opposite side, i.e. the opposite end section of the sheet-metal part. As soon as they have bent and have assumed their proper position, to be precise the fixed position, the retaining arms spring back some way with their latching lugs such that the latching lugs engage in the corresponding undercut on the opposite side.

In a preferred embodiment of the invention, it is provided that in order to perform the abovementioned step c), the intended bending point is applied to the spring arms by means of a recess or notch in the respective longitudinal side edge, and to be precise in the region of the spring arms themselves, preferably at a point on the longitudinal side edge which lies at the point of intersection of the extension of the transverse side edge and the respective longitudinal side edge, and thus at the point of connection of the spring arm itself. In this way, the spring arm can be bent outward about its point of connection on the transverse side edge some way further from its originally assumed position so as to ensure that, when the sheet-metal part is rolled up, the front side edges can be moved toward each other at a single assembly height.

This has the particular advantage that a considerably simpler tool for performing the stamping/bending process can be provided. Namely, because the rolling procedure can be designed such that, when the end sections of the sheet-metal part produced for this purpose are rolled together, they can be moved toward each other, and to be precise can be moved toward each other as part of an assembly operation, there is one less step in which, for example, one of the end sections needs to be over- or underlapped in order then to thread it into a corresponding matching contour, such as for example a dovetail interlocking connection, in a complex movement sequence.

According to the concept of the present invention, the front sides can therefore be brought together in a simple fashion, the retaining arms first springing out and then engaging with their end section designed for latching in corresponding matching latching recesses on the opposite side.

In a further advantageous embodiment, the method is provided in such a way that the sheet-metal part is shaped such that the respective retaining arm is formed from an elongated arm section, on the respective free retaining arm end of which is formed a latching lug which faces the other retaining arm. They have a slanting side edge which serves as a control surface for interaction with a corresponding edge surface of the opposite transverse side edge.

It is also advantageously provided if the method is configured such that, when the sheet-metal part is produced, the end section, and to be precise that end section which does not comprise the retaining arms, is shaped as follows:

- this end section is designed with a smaller width in the region of the front side than the width in the central section of the sheet-metal part, and
- retaining tabs, preferably with a more or less trapezoidal shape or at least partially trapezoidal, are provided at the corners of the front side of the transverse side edge of this end section and each form a respective outwardly slanting side edge which serves for interaction with the abovementioned oblique front side edges of the retaining arms or the latching lugs of these retaining arms.

In a further advantageous embodiment of the method according to the invention, it is provided that, during the connection of the end sections of the sheet-metal part, said end sections are moved toward each other within an assembly plane and, when they are brought together, the retaining arms of the end section are, as mentioned above, pushed outward by their side edge bearing against the front-side control edge (also mentioned above) on the opposite end section.

It is furthermore considered advantageous that, after the abovementioned step c), the two retaining arms are pushed with force applied by a tool, and preferably bent plastically, with their latching lugs toward the corresponding recesses, and to be precise from an assembled position into a fixed position.

In other words, this means that, after the rolling process, as soon as the latching lugs of the retaining arms engage in the corresponding recesses on the opposite end section of the piece of sheet metal, there is still a small range of movement for the retaining arms. For this purpose, it can be provided, within the scope of a plastic deformation of the retaining arms, that the latter are deformed or pushed either by means of a tool or by force applied by a tool from the abovementioned position into their end position (fixed position).

In this way, a positive connection between the latching lugs and the corresponding recesses is formed. In the fixed position, the latching lugs thus dip completely into the recesses on the opposite end section.

In a further advantageous embodiment of the method, it is provided that at least one, preferably two or more raised portions (for example, stampings) are formed along one longitudinal side edge, on the inside of the jack sleeve, which serve as an end stop for a front side edge of a contact lamination lattice which is to be inserted into the jack sleeve.

It can also advantageously be provided that at least one, preferably two or more, window-like recesses are introduced in the sheet-metal part, along the longitudinal side edge, for the spring arms of the contact lamination lattice to dip into in order to fix the contact lamination lattice in the jack sleeve. In this way, it can be provided according to the invention that two strips are moved next to each other in a manufacturing process, wherein, from one metal strip or sheet-metal strip, the abovementioned sheet-metal part serves to produce the cylindrical jack sleeve, whilst the other sheet-metal part serves to produce the contact lamination lattice. The contact lamination lattice can be introduced into the jack sleeve such that the latter bears against the abovementioned stops with its leading front-side end, whilst at the same time the spring arms formed by the contact lamination lattice dip into the abovementioned recesses in the sheet-metal part of the jack sleeve.

In a further advantageous embodiment of the method according to the invention, it is provided that, in each case at the front of the end sections, mutually corresponding centering elements are attached which in each case provide slanting side edges which, when they bear against the respective opposite centering element, are guided under force such that the end sections are automatically aligned when they are moved together, notably when the front sides of the latter come into contact with each other within an assembly plane.

A further aspect of the present invention relates to an electric plug-in connector jack.

According to the invention, an electric plug-in connector jack is therefore also proposed, comprising a cylindrical jack sleeve, wherein the jack sleeve is designed with a receiving space into which a cylindrical laminated cage with a plurality of contact laminations which extend in parallel is inserted, wherein the cylindrical jack sleeve is formed from an essentially flat sheet-metal part consisting of two end sections and a central section situated between them, wherein the sheet-metal part has two longitudinal side edges extending in each case from one end section to the opposite end section, and has in each case one transverse side edge which in each case delimits one of the two end sections, wherein in each case, in an extension of the longitudinal side edges, two retaining arms protrude at the front of the end section from the transverse side edge of the sheet-metal part, and wherein the retaining arms have, at their respective free retaining arm end, a latching lug by means of which said retaining arm end engages in an undercut which in each case is designed as a corresponding recess in the opposite end section of the piece of sheet metal, wherein an intended bending point is provided by means of a recess in the longitudinal side edge in the region of the respective retaining arm.

Other embodiments of the invention are apparent from the patent claims and the drawings and the associated description of the drawings, wherein, in the drawings:

The invention is explained in detail below with the aid of an exemplary embodiment with reference to FIGS. 1 to 4, wherein the same reference numerals refer to the same functional and/or structural features.

Figure 1:
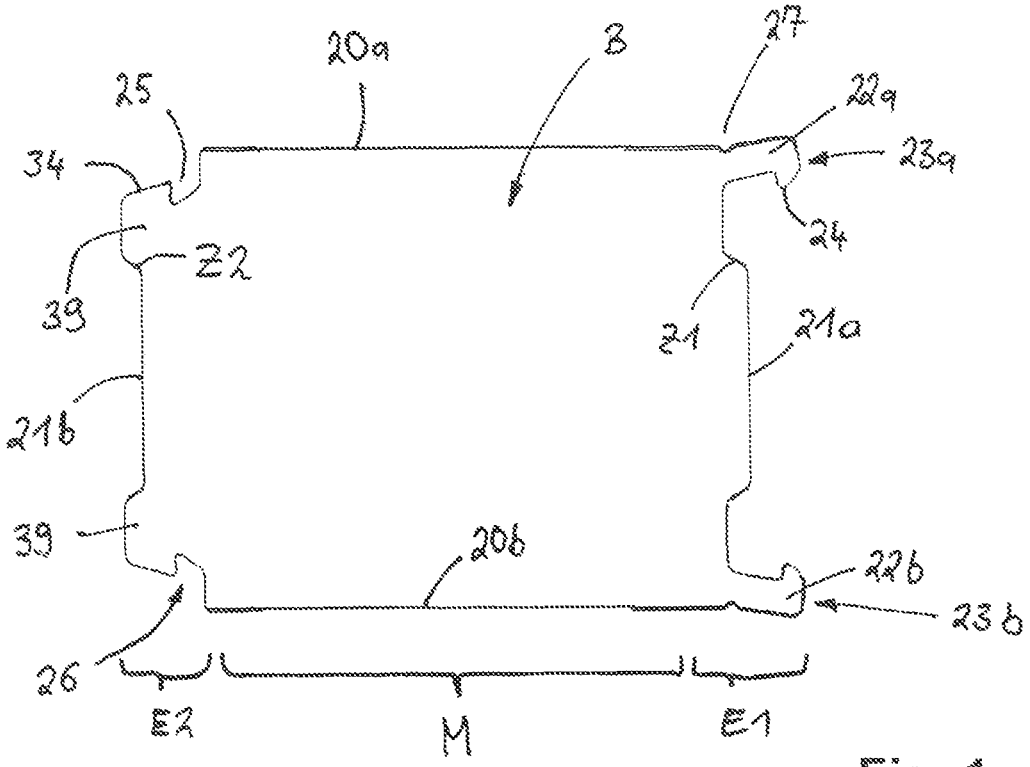
FIG. 1 shows a rolled-up form of a sheet-metal part B according to an exemplary embodiment of the present invention from which a cylindrical jack sleeve is formed in a manner according to the invention.
Figure 4:
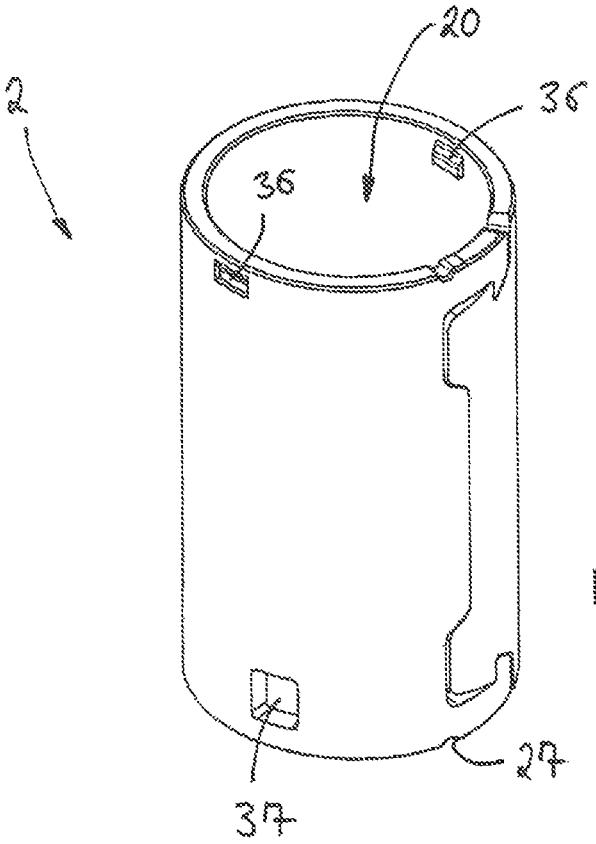
FIG. 4 shows a perspective view of a cylindrical jack sleeve, produced using the method according to the invention.

A view of an unrolled sheet-metal part B, from which the cylindrical jack sleeve 2 shown in FIG. 4 is produced according to the abovedescribed method according to the invention, is shown first in FIG. 1.

The sheet-metal part B consists of two end sections E1 and E2 and a central section M situated between them. The sheet-metal part moreover in each case has two longitudinal side edges 20*a*, 20*b* extending from one end section to the opposite end section E1, E2, and has in each case one transverse side edge 21*a*, 21*b* which in each case delimits one of the two end sections E1, E2.

As can also be seen, the sheet-metal part B has an essentially rectangular basic shape, wherein the transverse side edges 21*a*, 21*b* extend non-linearly, as is described in more detail below.

As can further be seen in the unrolled view in FIG. 1, in an extension of the longitudinal side edges 20*a* and 20*b* respectively, two retaining arms 22*a*, 22*b* protrude at the front from the transverse side edge 21*a* of the sheet-metal part B, and to be precise from the end section E1.

As can further be seen, the retaining arms 22*a*, 22*b* have, at their respective free retaining arm ends 23*a*, 23*b*, a latching lug 24 which is designed so as to engage in an undercut 25, described below, which in each case is designed as a corresponding recess 26 in the opposite end section E2 of the piece of sheet metal, as can be clearly seen, for example, in FIGS. 3 and 4.

Figure 2:
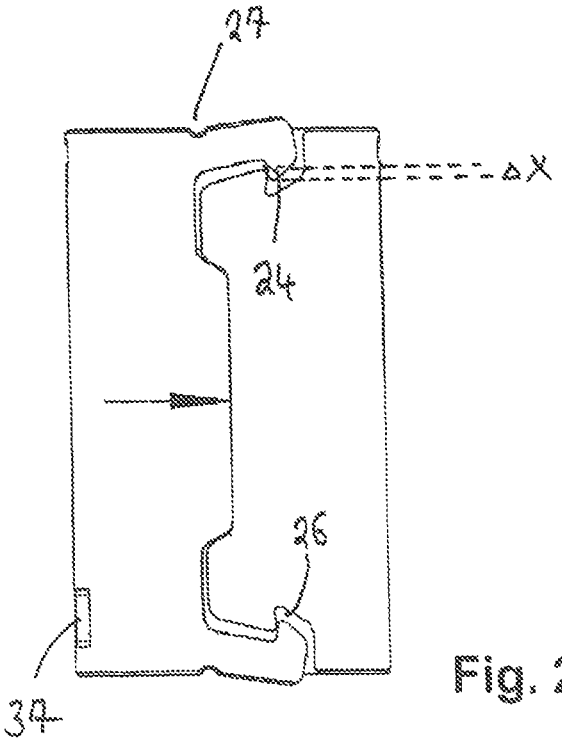
FIG. 2 shows a cylindrical jack sleeve during the method according to the invention in an intermediate step.

The sheet-metal part B shown and described in FIG. 1 is preferably produced by means of a stamping process. During the production of this sheet-metal part B, or after it, in each case one intended bending point 27 is introduced in the longitudinal side edges 20*a*, 20*b*, and to be precise in the region of the retaining arms 22*a*, 22*b*, as can also be clearly seen in FIGS. 1 to 4. The intended bending points 27 are here provided as small semi-circular notches in the longitudinal side edges 20*a*, 20*b*. The abovedescribed sheet-metal part B is then deformed by rolling, i.e. by a shaping process, to form a cylindrical jack sleeve 2, as shown in FIG. 2. During the rolling or shaping of the sheet-metal part B, the retaining arms 22*a*, 22*b* attached to the end section E1 of the sheet-metal part B are first sprung or bent outward as intended about the intended bending point 27 when they make contact with the front side of the opposite end section E2 of the sheet-metal part B until the latching lugs 24 of said retaining lugs 22*a*, 22*b* spring some way further into the corresponding recess 26, as shown in FIG. 2.

When brought together, the slanting side edges 31 of the retaining arms 22*a*, 22*b* and the latching lugs 24 of these retaining arms 22*a*, 22*b* travel on the slanting matching contours (described in more detail below) on the opposite end section E2. By virtue of their interaction with the corresponding slanting side edges which extend in the opposite fashion, the retaining arms 22*a*, 22*b* spring outward and then spring back into their final position in the abovementioned recesses 26. This state is illustrated by way of example in FIG. 2, in which the latching lugs 24 of the retaining arms 22*a*, 22*b* dip by a certain amount into the recesses 26.

Figure 3:
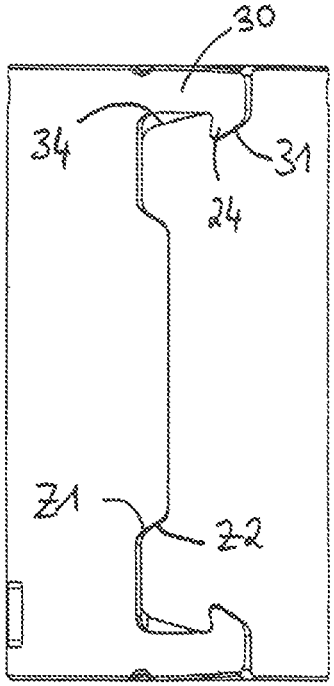
FIG. 3 shows the cylindrical jack sleeve from FIG. 2 in a further assembly step.

As in the abovementioned step, FIG. 3 shows how the two retaining arms 22*a*, 22*b* are pushed with force applied by a tool, and thus preferably deformed or bent plastically, with their latching lugs toward the corresponding recess 26, from their assembled position into their fixed position.

As shown in FIG. 3 by the two arrows, the retaining arms are as it were deformed not elastically but plastically from the position shown in FIG. 2 into the position shown in FIG. 3 such that, after the tools or the force have/has been removed, the retaining arms remain in this position in which the latching lugs 24 project completely into the recess 26, and a positive connection is formed between the latching lugs and the retaining arms.

As is moreover shown in FIG. 1, the sheet-metal part is shaped during its production such that the respective retaining arm 22*a*, 22*b* is formed from an essentially elongated arm section 30, on the respective free retaining arm end 23*a*, 23*b* of which a latching lug 24 facing the other retaining arm

22*a*, 22*b* is formed such that each retaining arm 22*a*, 22*b* has an approximately L-shaped form. Moreover, an abovedescribed slanting side edge 31, which serves as a control curve and to be precise for interaction with a likewise slanting edge surface 34 of the opposite transverse side edge 21*b*, is formed on the latching lug 24.

As can also be seen in FIGS. 1 to 4, the sheet-metal part B is formed such that the width of the end section E2 in the region of the front side is designed to be smaller than in the central section M, and that retaining tabs are provided at the corners of the front side of the transverse side edge 21*a*, 21*b* of the end section E2.

The retaining tabs have an approximately trapezoidal or lobed shape and directly adjoin in an integral fashion the corners of the end section E2. These retaining tabs 39 each have a slanting, outward directed side edge 34 which serves to cause the retaining arms 22*a*, 22*b* to spring back when it interacts with the abovementioned slanting front side edges 31.

The process of rolling the sheet-metal part B to form the cylindrical jack sleeve 2 is not shown in detail but can be described as follows.

The flat sheet-metal part B is brought into a cylindrical shape by means of a tool in such a way that the fronts of the end sections E1, E2 of the sheet-metal part B are moved toward each other within a common assembly plane in order for the retaining arms 22*a*, 22*b* of the end section E1 to be pushed outward when the said end sections meet each other by bearing via their slanting side edge against the front control edge 34*a* on the opposite end section E2, and by springing into the recesses 26 after the final assembly position has been reached. In this position, the front sides of the transverse side edges 21*a*, 21*b* touch each other.

As can further be seen from FIG. 1, the sheet-metal part B is shaped such that in each case mutually corresponding centering elements Z1, Z2, which in each case provide slanting side edges and are guided under force when they come into contact with the respective opposite centering element Z1 or Z2 such that the end sections E1, E2 are automatically aligned when joined together, are attached or formed on the front of the end sections E1, E2.

As can further be seen from FIG. 4, two raised portions 36 have been attached to the inside of the jack sleeve 2, which serve as an end stop for a front side edge of a contact lamination lattice 3 which is to be inserted into the jack sleeve. The contact lamination lattice 3 is inserted into the cylindrical jack sleeve 2 shown in FIG. 3 from the side and below until its front side edge bears against the abovementioned end stops 36. When they reach these stops, at the same time spring arms (not shown in detail) of the contact lamination lattice 3 latch into window-like recesses 37 which have been introduced into the sheet-metal part B and hence fix the contact lamination lattice 3 in the jack sleeve 2 in order, as a whole, to provide the plug-in connector sleeve 1 according to the invention.

The embodiment of the invention is not restricted to the preferred exemplary embodiments described above. A number of alternatives is instead conceivable which make use of the solution shown even in embodiments of a fundamentally different nature.

LIST OF REFERENCE NUMERALS

1 plug-in connector jack
2 jack sleeve
3 contact lamination lattice
20 receiving space
20*a*, 20*b* longitudinal side edges
21*a*, 21*b* transverse side edges
22*a*, 22*b* retaining arms
23*a*, 23*b* retaining arm ends
24 latching lug
25 undercut
26 recess
27 intended bending point
30 arm section
31 front side edge
34 control edge/side edge/edge surface
34*a* control edge
36 raised portions
37 recess
39 retaining tabs
B sheet-metal part
E1, E2 end sections
M central section
Z1, Z2 centering elements/centering edges
Δx section

The invention claimed is:

1. A method for producing an electrical plug-in connector jack, comprising a cylindrical jack sleeve, wherein the jack sleeve has a receiving space in which a cylindrical contact lamination lattice with a plurality of contact laminations extending parallel to one another is inserted, comprising the steps of:

a. producing an essentially flat sheet-metal part comprising of first and second end sections and a central portion situated between them, wherein the sheet-metal part has two longitudinal side edges which extend, in each case, from the first end section to the second end section, and a transverse side edge which, in each case, delimits one of the first and second end sections, wherein in an extension of the longitudinal side edges, two retaining arms project from the transverse side edge of the sheet-metal part, from the first end section, wherein the retaining arms have, at respective free retaining arm ends thereof, a latching lug for engagement in an undercut which, in each case, takes the form of a corresponding recess in the second end section of the sheet-metal part, wherein two retaining tabs project from the transverse side edge of the second end section, and wherein a first centering element protrudes from the transverse side edge of the first end section and is located between the retaining arms and a second centering element protrudes from the transverse side edge of the second end section and is located between the retaining tabs;

b. introducing an intended bending point for each of the retaining arms in the respective longitudinal side edge outwardly delimiting the respective retaining arm; and c. rolling the sheet-metal part to form a cylindrical jack sleeve such that the retaining arms bear against a front side of the retaining tabs on the second end section of the sheet-metal part, so that each of the retaining arms is first sprung or bent outward about the intended bending point thereof until the latching lug thereof springs into the corresponding recess and the first and second centering elements align the first and second end sections.

2. The method as claimed in claim 1 wherein the intended bending point is applied to each retaining arm by a recess or notch in the respective longitudinal side edge in a region of each retaining arm at a point on the longitudinal side edge which lies at the point of intersection of the extension of the transverse side edge and the respective longitudinal side edge.

3. The method as claimed in claim 1 wherein during connection of the first and second end sections of the sheet-metal part, said first and second end sections are moved toward each other within an assembly plane and, when the first and second end sections are brought together, the retaining arms are pushed outward by side edges thereof bearing against a front-side control edge on the second end section.

4. The method as claimed in claim 1 wherein the two retaining arms are pushed with force applied by a tool, and bent plastically, with the latching lugs thereof moved toward the corresponding recesses, from an assembled position into a fixed position.

5. The method as claimed in claim 1 wherein two or more raised portions are formed on an inside of the jack sleeve, which serve as an end stop for a front side edge of the contact lamination lattice which is to be inserted into the jack sleeve.

6. The method as claimed in claim 1 wherein two or more window-like recesses are introduced in the sheet-metal part, along the longitudinal side edge, for spring arms of the contact lamination lattice to dip into in order to fix the contact lamination lattice in the jack sleeve.

7. The method as claimed in claim 1 wherein the centering elements provide corresponding slanting side edges which bear against each other and are guided under force such that the first and second end sections are automatically aligned when joined together.

8. The method as claimed in claim 1 wherein the sheet-metal part is shaped such that each retaining arm is formed from an elongated arm section, the respective latching lug faces the other retaining arm and has a slanting side edge which serves as a control surface for interaction with an edge surface of the opposite transverse side edge.

9. The method as claimed in claim 8 wherein when the sheet-metal part is produced, the second end section is shaped as follows: a width of the end section is smaller in a region of a front side than in the central section, and the retaining tabs, which in each case form an outwardly slanting side edge for interaction with the slanting side edges of the latching lugs, are provided at corners of the front side of the transverse side edge of the end section.

10. An electric plug-in connector jack, comprising:

a cylindrical jack sleeve having a receiving space into which a cylindrical laminated cage with a plurality of contact laminations is inserted, the cylindrical jack sleeve being formed from an essentially flat sheet-metal part comprising of first and second end sections and a central section situated therebetween, wherein the sheet-metal part has two outer longitudinal side edges extending in each case from the first end section to the second end section, and has, in each case, one transverse side edge which, in each case, delimits one of the first and second end sections, wherein, two retaining arms protrude at a front of the first end section from the transverse side edge of the sheet-metal part, wherein the retaining arms have, at respective free retaining arm ends, a latching lug configured to engage in an undercut which, in each case, is designed as a corresponding recess in the second end section of the flat sheet-metal part, wherein an intended bending point is provided by a recess in the outer longitudinal side edge in a region of the respective retaining arm, and wherein two retaining tabs protrude from a front of the second end section, each retaining tab has a slanted side edge for engaging a corresponding slanted side edge of the respective retaining arm.

11. The electric plug-in connector jack as claimed in claim 10, wherein a first centering element is positioned between the retaining arms and a second centering element is positioned between the retaining tabs, the first and second centering elements have corresponding slating side edges for aligning the first and second end sections.

12. The electric plug-in connector jack as claimed in claim 10, wherein the two retaining arms are substantially identical.

* * * * *